US005994834A

United States Patent [19]

Alwan et al.

[11] Patent Number: 5,994,834

[45] Date of Patent: Nov. 30, 1999

[54] CONDUCTIVE ADDRESS STRUCTURE FOR FIELD EMISSION DISPLAYS

[75] Inventors: James J. Alwan; Kevin Tjaden, both of Boise, Id.

[73] Assignee: Micron Technology, Inc., Boise, Id.

[21] Appl. No.: 08/917,445

[22] Filed: Aug. 22, 1997

[51] Int. Cl.[6] ..... H01J 1/30; H01J 19/24

[52] U.S. Cl. ..... 313/497; 313/309; 313/336

[58] Field of Search ..... 313/336, 309, 313/351, 495, 496, 497, 422; 315/169.1

[56] References Cited

U.S. PATENT DOCUMENTS

| | | | |
|---|---|---|---|
| 5,229,331 | 7/1993 | Doan et al. | 445/50 |
| 5,302,238 | 4/1994 | Roe et al. | 445/50 |
| 5,374,868 | 12/1994 | Tjaden et al. | 313/310 |
| 5,473,222 | 12/1995 | Thoeny et al. | 315/169.1 |
| 5,521,461 | 5/1996 | Garcia | 313/336 |
| 5,601,466 | 2/1997 | Shen et al. | 313/309 |
| 5,651,713 | 7/1997 | Lee et al. | 313/336 |
| 5,726,530 | 3/1998 | Peng | 313/495 |
| 5,828,163 | 10/1998 | Jones et al. | 313/336 |
| 5,838,095 | 11/1998 | Tanaka et al. | 313/309 |

FOREIGN PATENT DOCUMENTS

| | | | |
|---|---|---|---|
| 0278405 | 8/1988 | European Pat. Off. | H01J 1/30 |
| 2697660 | 5/1994 | France | G09G 3/20 |
| 2714209 | 6/1995 | France | H01J 1/30 |
| 2718269 | 10/1995 | France | G09G 3/20 |
| WO88/01098 | 2/1988 | WIPO | H01J 31/12 |

*Primary Examiner*—Michael Day
*Attorney, Agent, or Firm*—Seed and Berry, LLP

[57] ABSTRACT

An emitter structure for a field emission display includes: a substrate (100) having a top surface; an address line (142) embedded in the substrate (100) and having an upper surface substantially coplanar with the top surface of the substrate (100); and an emitter site (152) having an emitter (154) superjacent to the top surface of the substrate (100) apart from the address line (142) and having a contact (153) having a first portion coupled to the emitter (142) and a second portion coupled to the address line (142). The substrate (100) may further include a base layer (110), and a dielectric layer (120), and the contact (153) may further act as a resistor to limit the current to the emitter (154).

45 Claims, 8 Drawing Sheets

CONDUCTIVE ADDRESS STRUCTURE FOR FIELD EMISSION DISPLAYS

STATEMENT OF GOVERNMENT INTEREST

This invention was made with government support under contract number DABT63-93-C-0025 awarded by Advanced Research Projects Agency (ARPA). The government has certain rights in this invention.

TECHNICAL FIELD

The present invention relates to the manufacturing of field emission displays and other related microelectronic devices. More specifically, the present invention relates to fabricating address lines in baseplates of field emission displays.

BACKGROUND OF THE INVENTION

Field emission displays ("FEDs") are flat panel displays for use in computers, television sets, instrument displays, camcorder view finders and a variety of other applications. FEDs generally have a face plate with a substantially transparent anode covering an inner surface of a glass panel and a cathodoluminescent film covering the anode. FEDs also have a baseplate with an emitter substrate and an extraction grid. FIG. 1 illustrates a portion of a conventional FED baseplate 20 with an emitter substrate 30 that carries a plurality of emitters 32. The emitter substrate 30 also carries a dielectric layer 40 with a plurality of cavities 42 around the emitters, and the dielectric layer 40 supports a conductive extraction grid 50 with a plurality of holes 52 over the emitters 32. The cavities 42 and the holes 52 expose the emitters 32 to the face plate (not shown).

FIG. 2 is a top schematic view of the baseplate 20 that illustrates one technique for extracting electrons from selected emitters. The emitters 32 may be grouped into discrete emitter sets 33 configured in rows (e.g., $R_1$–$R_3$) and columns (e.g., $C_1$–$C_2$). A number of high-speed row interconnects 60 on the extraction grid 50 commonly connect a plurality of emitter sets 33 along row address lines, and a number of high-speed column interconnects 70 on the emitter substrate 30 commonly connect emitter sets 33 along column address lines. As best shown in FIG. 1, the row interconnects 60 are formed on top of the extraction grid 50 and the column interconnects 70 are formed on top of the emitter substrate 30 and beneath the extraction grid 50. It will be appreciated that the row and column assignments illustrated in FIGS. 1 and 2 are for illustrative purposes only, and that other row/column assignments may be implemented in field emission displays.

To operate a specific emitter set 33, drive circuitry (not shown) generates row and columns signals along the coordinates of the specific emitter set 33 to create a voltage differential between the extraction grid and the specific emitter set. Referring to FIG. 2, for example, a row signal along row $R_2$ of the extraction grid 50 and a column signal along column $C_1$ of the emitter substrate 30 activates the emitter set 33 at the intersection of row $R_2$ and column $C_1$. The voltage differential between the extraction grid 50 and the selected emitter set 33 produces a localized electric field that extracts electrons from the emitters 32 in the selected emitter set. The anode on the face plate then attracts the extracted electrons across a vacuum gap between the extraction grid and the cathodoluminescent layer. As the electrons strike the cathodoluminescent layer, light emits from the impact site and travels through the anode and the display screen. The emitted light from each area becomes all or part of a picture element.

One manufacturing concern with FEDs is that it can be difficult to fabricate high-speed interconnects for the address lines in the baseplate. To form the interconnect 70, for example, a conductive layer is deposited onto the top of the substrate 30 prior to forming the emitters 32. The conductive layer is then patterned and etched to form the interconnect 70. The emitters 32 are subsequently constructed by depositing an emitter material on the substrate 30, patterning the emitter material, and then etching the emitter material with processes known in the art. The difficulty in fabricating the high-speed interconnects 70 arises because etching the metal layer is a dirty process that may befoul the substrate with contaminants. Even when the substrate is thoroughly cleaned, some of the contaminants may remain on the substrate and impair the performance of the baseplate.

Another manufacturing concern with FEDs is that the interconnects increase the difficulty of fabricating the extraction grid over the emitter substrate. The conventional interconnect 70 shown in FIG. 1 increases the step height over which the dielectric layer 40 and grid 50 must conform during the fabrication. Large step heights in the grid generally increase the complexity of planarizing the grid conductor during formation of the self-aligned holes over the emitters. Additionally, large step heights may also increase the complexity of depositing the dielectric and conductive layers, particularly in low temperature processes that do not have good conformal coverage over steep topographies. To avoid problems and defects produced by the increased complexity in depositing and planarizing the dielectric and conductive layers, the processes are generally slowed down to ensure that cracks do not form at large steps and that the baseplate is planarized to the correct endpoint. Reduced processing speeds increase the cost and difficulty in producing field emission displays. Also, even when great care is exercised in forming the extraction grid, large step heights may cause defects that impair the performance of the baseplate. Conventional interconnects, therefore, limit the ability to economically and reproducibly fabricate large quantities of field emission displays.

SUMMARY OF THE INVENTION

One embodiment of the present invention is an emitter structure in a baseplate of a field emission display having a substrate, an address line embedded in the substrate, and an emitter coupled to the address line. The substrate may carry the address line in a trench extending along a top surface of the substrate so that the top surface of the substrate and an upper surface of the address line are at least substantially coplanar with one another. The emitter may be a doped silicon cone or other protuberance projecting away from the top surface of the substrate and the upper surface of the address line. The emitter may be coupled to the address line via the doped silicon of the emitter or another conductive material. In one embodiment, the substrate has a semiconductive base layer and a dielectric layer on the base layer. The trench is cut into the dielectric layer so that an oxide pad is in the trench, and the address line fills the trench around at least a portion of the oxide pad. The upper surface of the address line and the top surface of the oxide pad and dielectric layer may be substantially coplanar with one another. The emitter may be constructed over the oxide pad so that the oxide pad supports the emitter above the address line. In another embodiment, the emitter may be constructed from a silicon layer directly over the address line so that the address line supports the emitter.

Another aspect of the present invention is a method for fabricating a conductive address structure in a field emission display. In one embodiment, a void is formed in the substrate and then a conductive layer is deposited onto the substrate to at least partially fill the void. An excess portion of the conductive layer is subsequently removed to form a conductive component in the void and a planar surface on the substrate prior to fabricating an emitter. An emitter is then constructed proximate to the conductive component so that the conductive component can electrically influence the emitter to selectively emit electrons. The emitter, for example, may be constructed above the conductive line by depositing and etching an emitter layer so that the emitter projects away from the upper surface of the conductive line.

DETAILED DESCRIPTION OF THE INVENTION

The present invention is a method and an emitter structure for constructing conductive components in the manufacturing of baseplates for field emission displays. It will be appreciated that specific details of the invention are set forth in the following description and in FIGS. 3A–4E to provide a thorough understanding of certain embodiments of the present invention. One skilled in the art, however, will understand that the present invention may have additional embodiments that may be practiced without these details.

Figure 1:
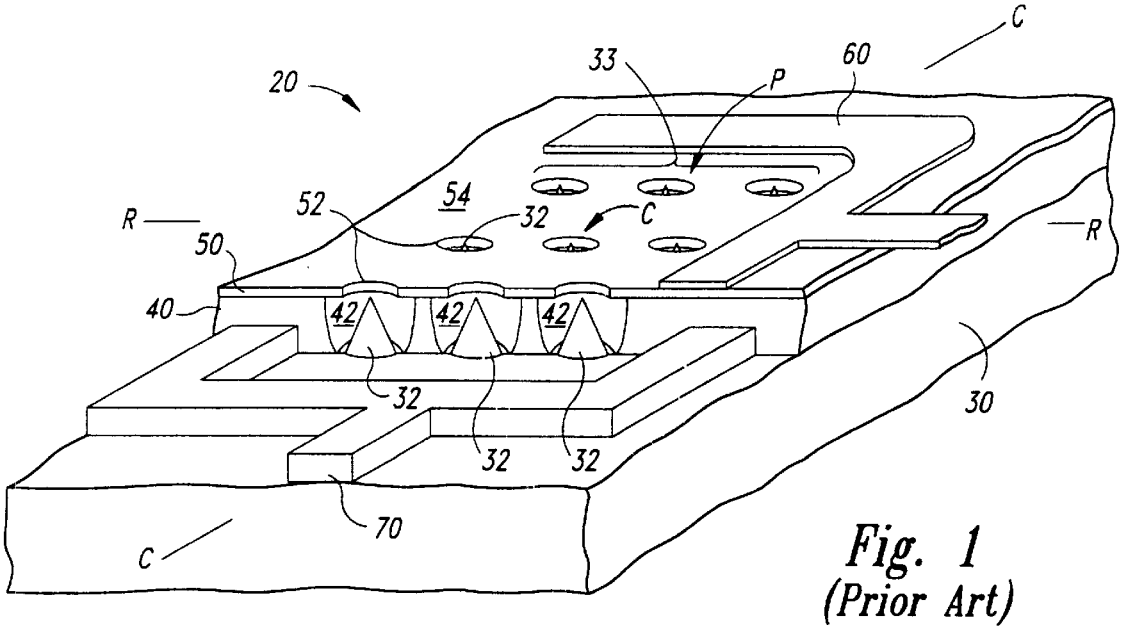
Fig. 1 (Prior Art)
FIG. 1 is a partial schematic isometric view of a baseplate for a field emission display in accordance with the prior art.
Figure 2:
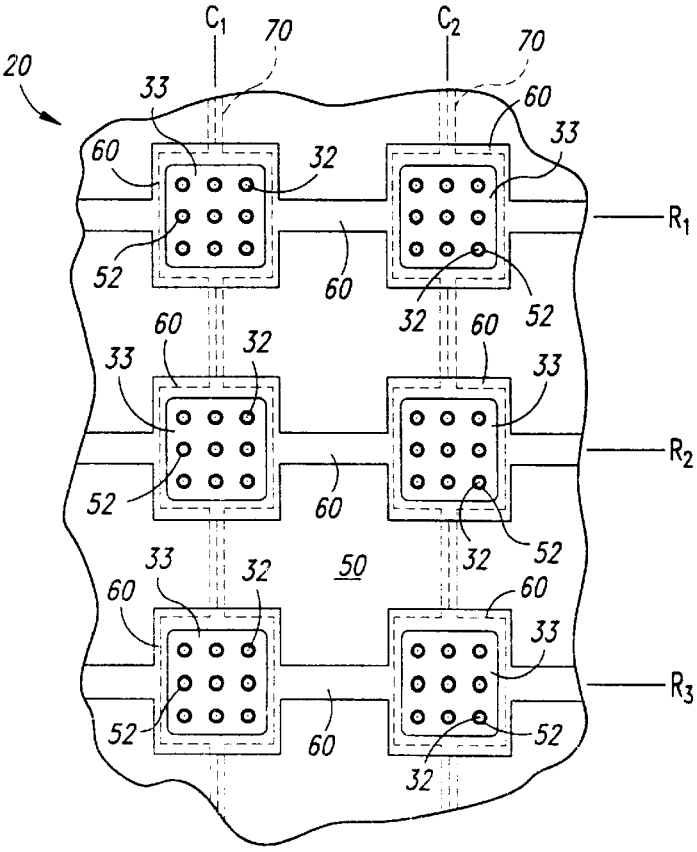
Fig. 2 (Prior Art)
FIG. 2 is a partial schematic top view of the baseplate of FIG. 1.
Figure 3A:
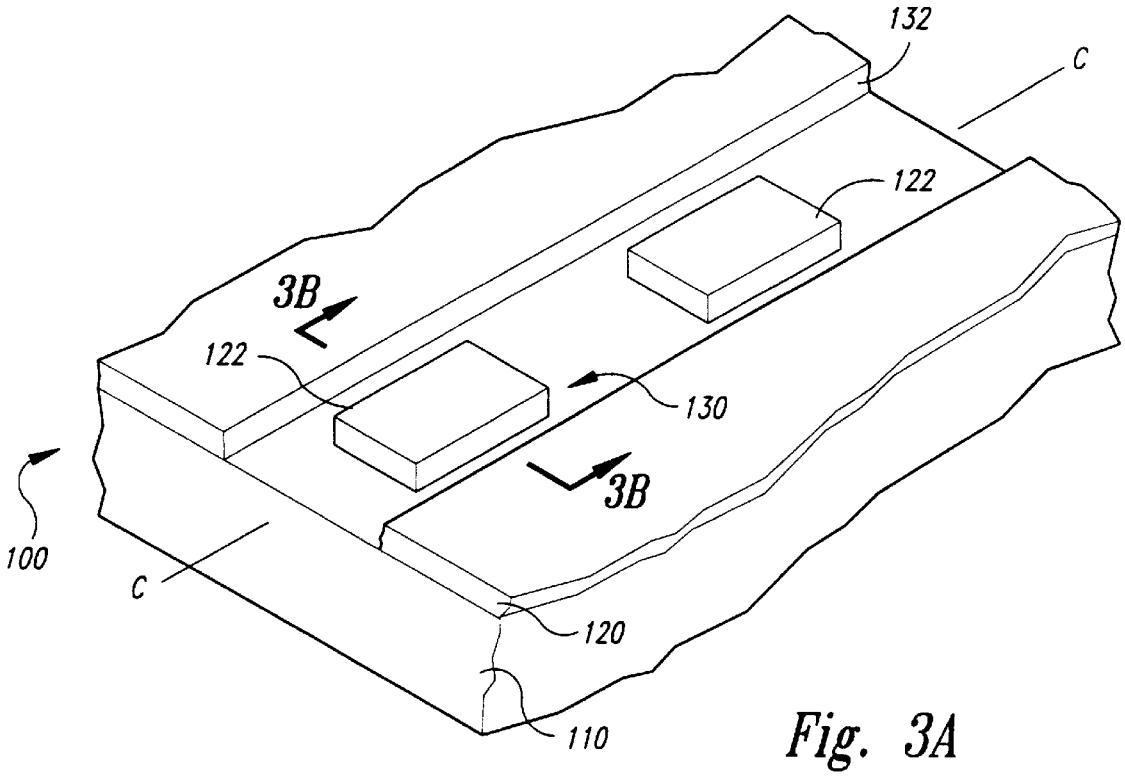
FIG. 3A is a partial schematic isometric view illustrating a substrate at one stage in an embodiment of a method for fabricating a baseplate of a field emission display in accordance with the invention.

FIGS. 3A–3H are partial schematic views that illustrate constructing an address line embedded in a substrate 100 according to one embodiment of the invention. Referring to FIG. 3A, the substrate 100 has a base layer 110 and a dielectric 120 covering the base layer 110. The base layer 110 may be composed of a semiconductive material (e.g., single crystal silicon or polysilicon) or a non-semiconductive material (e.g., glass). A number of features (not shown) are generally formed in the base layer 110, such as wells, sources, drains, field oxides, or other types of features commonly formed in semiconductive layers. The dielectric layer 120 is composed of silicon oxide, borophosphate silicon glass (BPSG), tetraethylorthosilicate glass (TEOS) or other highly resistive materials.

The base layer 110 is typically covered by depositing the dielectric layer 120 onto the base layer 110 with techniques known in the art. A void 130 is cut in the dielectric layer 120 along a column line C—C defining a line along which a column of commonly connected emitters are to be formed on the substrate 100. The void 130 is cut by patterning a resist (not shown) on the dielectric layer 120, etching the dielectric layer 120 to a desired depth, and removing the resist in a manner well known in the art. As shown in FIG. 3A, the void 130 may be a trench 132 in which pads 122 project upwardly from the base layer 110 at selected intervals along the trench 132. The pads 122 may be islands as shown in FIG. 3A, or may also have a variety of other configurations (not shown), such as a configuration in which the pads 122 are contiguous with the rest of the dielectric layer 120 and extend into the trench 132 transversely with respect to the column C—C. After the trench 132 is cut in the dielectric layer 120, a high-speed address line is formed in the trench.

Figure 3B:
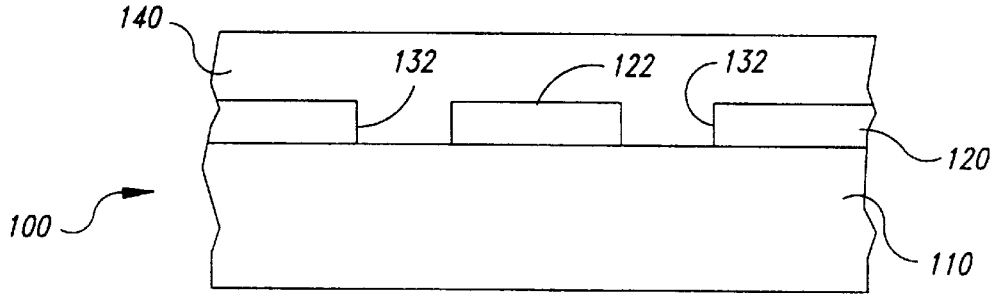
FIG. 3B is a partial schematic cross-sectional view illustrating the substrate of FIG. 3A at another stage of the method for fabricating a baseplate in accordance with the invention.
Figure 3C:
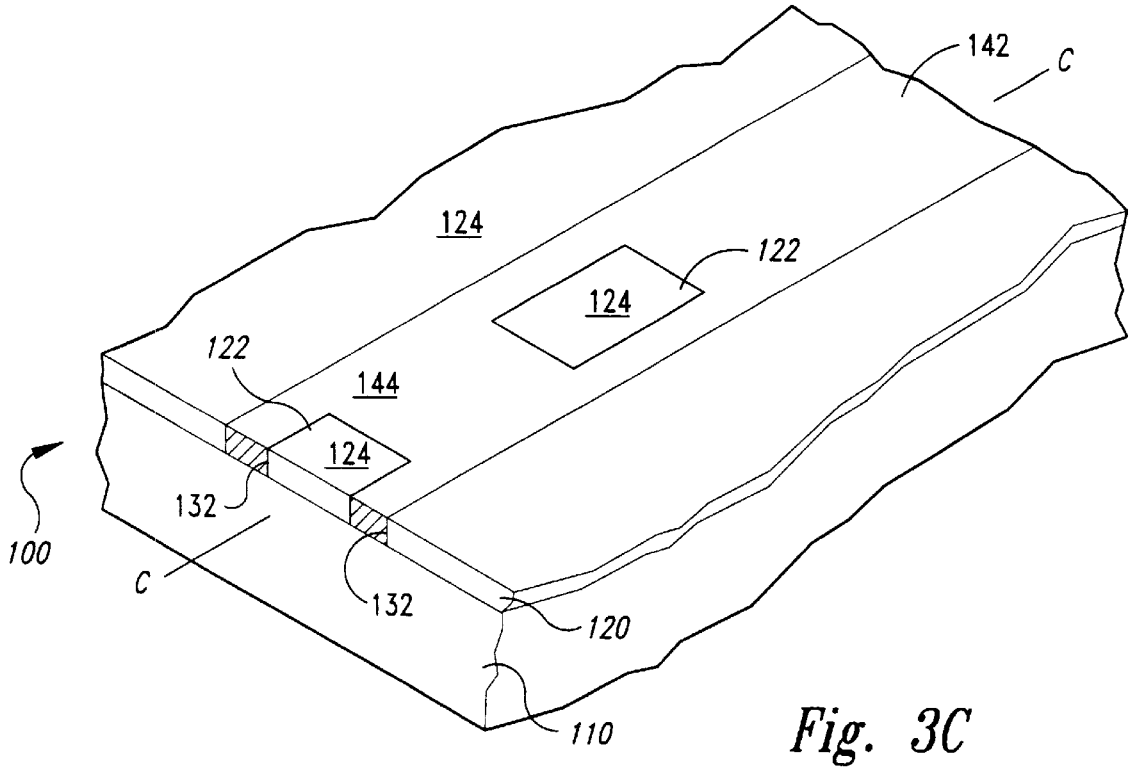
FIG. 3C is a partial schematic isometric view illustrating the substrate of FIGS. 3A and 3B at another stage of the method for fabricating a baseplate in accordance with the invention.

FIGS. 3B and 3C illustrate forming a high-speed conductive line in the trench 132. As shown in FIG. 3B, a conductive layer 140 is deposited onto the substrate 100 to fill the trench 132 with conductive material. The conductive layer 140 is generally composed of aluminum, copper, tungsten, gold, silver or other suitable conductive materials. An excess portion of the conductive layer 140 above the top surface of the dielectric layer 120 is then removed to form a conductive address line 142 in the trench 132 (shown in FIG. 3C). The conductive address line 142 may have a top surface 144 that is at least substantially coplanar with a top surface 124 of the dielectric layer 120 and the pads 122. In other embodiments, however, the address line 142 may be embedded in the substrate 100 so that the top surface 144 of the address line 142 is not coplanar with the top surface 124 of the dielectric layer 120 and the pads 122. Suitable techniques to remove the excess portion of the conductive layer 140 include mechanical or chemical-mechanical planarization processes in which the substrate 100 presses against an abrasive medium in the presence of a planarizing liquid.

In a typical planarizing process, the substrate 100 translates across the surface of a rotating polishing pad in the presence of an abrasive slurry to abrade and/or dissolve material from the surface of the substrate 100. The substrate 100 is planarized to an endpoint at which the remaining portion of the conductive layer 140 is electrically isolated in the trench 132 to form the address line 142 embedded in the substrate 100. The chemical-mechanical planarization process produces a planar surface in which a top surface 144 of the address line 142 is at least substantially coplanar with a top surface 124 of the dielectric layer 120 and the pads 122. At this point of the method, therefore, one or more emitters may be formed on the planar surface of the pads 122 and/or the address line 142 along column C—C.

Figure 3D:
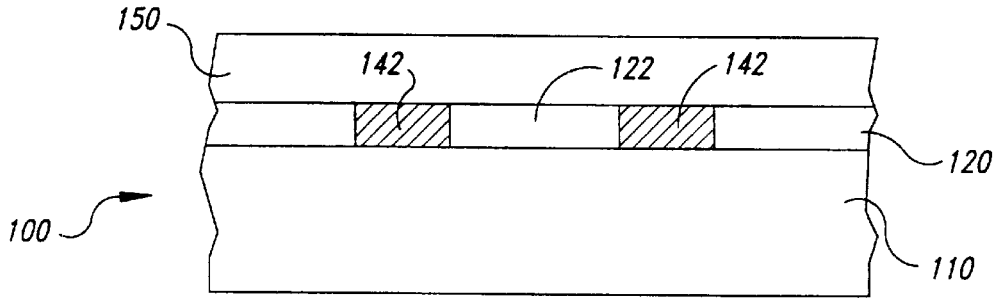
FIG. 3D is a partial schematic cross-sectional view illustrating the substrate of FIGS. 3A–3C at another stage of the method for fabricating a baseplate in accordance with the invention.
Figure 3E:
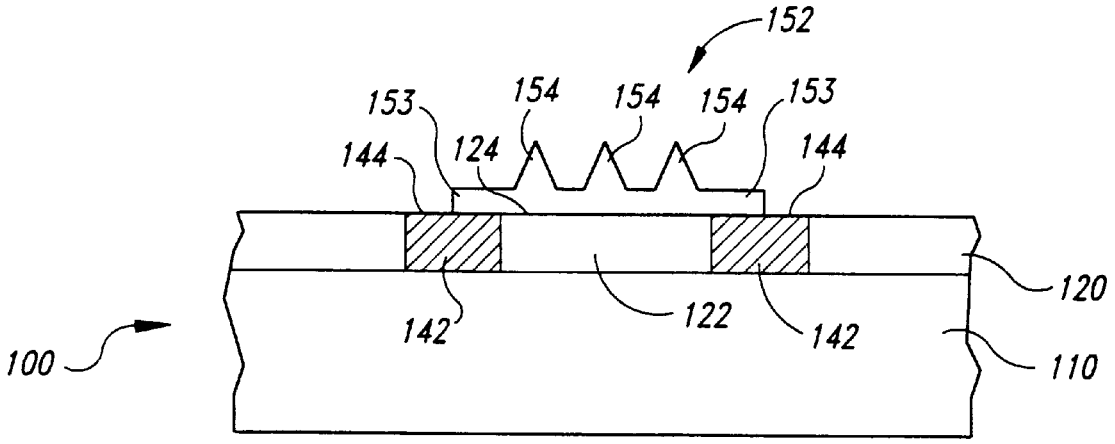
FIG. 3E is a partial schematic cross-sectional view illustrating the substrate of FIGS. 3A–3D at another stage of the embodiment for fabricating a baseplate in accordance with the invention.

FIGS. 3D and 3E illustrate forming an emitter on a pad 122 and the conductive line 142. Referring to FIG. 3D, an emitter layer 150 is deposited over the substrate 100 to provide material for forming emitters. The emitter layer 150 may be composed of one or more layers of single crystal p-type silicon and/or n-type silicon. As shown in FIG. 3E, the emitter layer 150 may be patterned and etched to form an emitter site 152 over the pad 122 and at least a portion of the address line 142. The emitter site 152 has one or more emitters 154 superadjacent to the oxide pad 122 and projecting away from the top surface 124. The emitters 154 are known electron emitting structures for field emission displays, and are fabricated according to conventional fabrication techniques known in the art. Additionally, one skilled in the art will understand that although only three emitters are shown for clarity of presentation, the number of emitters 154 is typically much larger. The emitter site 152 may also have contacts 153 between the emitters 154 and the address line 142. In one embodiment, the contacts 153 are composed of polysilicon which acts as a resistor to limit current to the emitters 154. It will be appreciated that the length or resistivity of the contacts 153 may be increased to increase the resistance of the contacts 153 in a passive current limiting application. Additionally, active components such as transistors may be fabricated in the contacts 153 to form an active current limiting device. The emitter sites 152 are preferably formed over each pad 122 (shown in FIG. 3C) and configured so that a plurality of emitter sites are commonly connected along discrete columns defined by the underlying address lines 142. After the emitter sites 152 and emitters 154 are constructed, an extraction grid is constructed on the substrate 100.

Figure 3F:
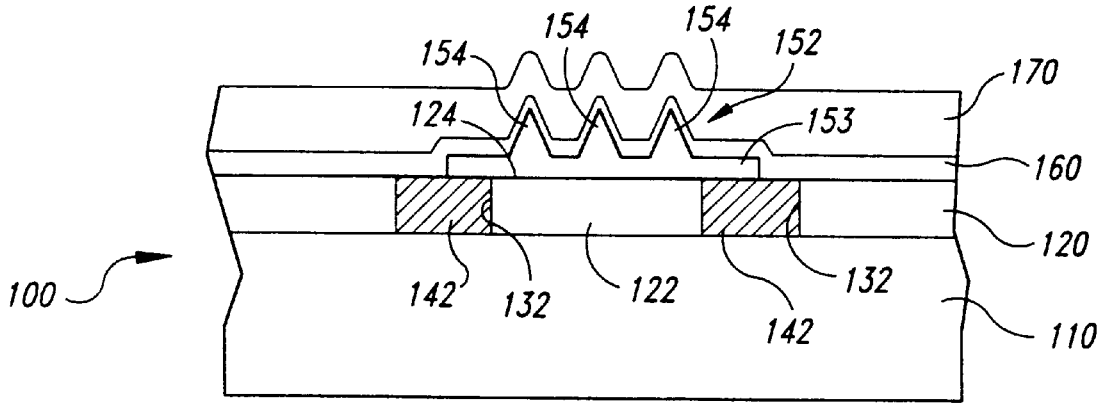
FIG. 3F is a partial schematic cross-sectional view illustrating the substrate of FIGS. 3A–3E at another stage of the method for fabricating a baseplate in accordance with the invention.
Figure 3G:
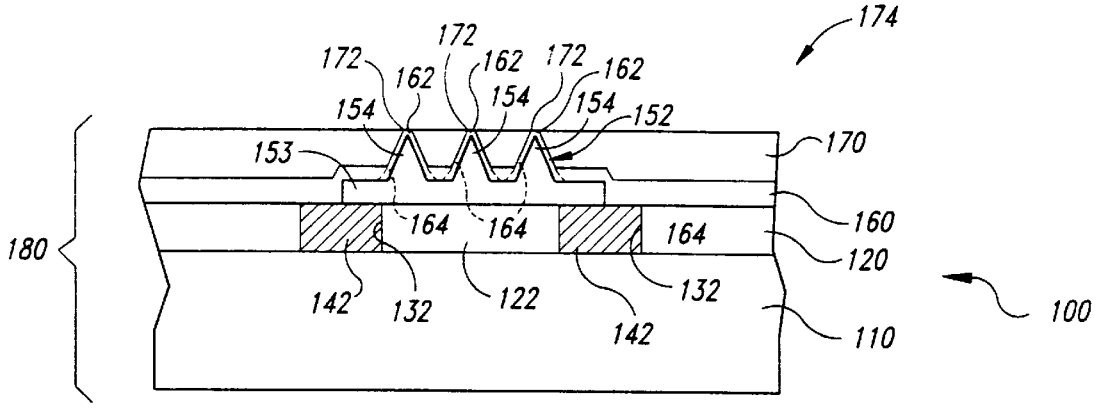
FIG. 3G is a partial schematic cross-sectional view illustrating an embodiment of a baseplate in accordance with the invention.

FIGS. 3F–3G illustrate forming an extraction grid 174 (FIG. 3G) over the dielectric layer 120 and the emitters 154. Referring to FIG. 3F, an insulator layer 160 deposited over the substrate 100 conformally covers the dielectric layer 120, the exposed portions of the address line 142, and the emitters 154. The insulator layer 160 may be composed of silicon oxide, BPSG, TEOS or other suitable dielectric materials. A grid layer 170 deposited over the substrate 100 conformally covers the insulator layer 160. The grid layer 170 is composed of aluminum, copper, polysilicon or other suitable conductive or semiconductive materials. As shown in FIG. 3G, the substrate 100 is planarized with a mechanical or chemical-mechanical planarization process forming a plurality of holes 172 in the grid layer 170 over the emitters 154 and exposing upper portions 162 of the insulator layer 160 above the emitters 154. The planarization process is accordingly endpointed at a level slightly above the apexes of the emitter 154 but below the apexes of the upper portions 162 of the insulator layer 160. After the substrate 100 has been planarized, cavities 164 (shown in broken lines) are selectively etched in the insulator layer 160 around the emitters 154 to open the holes 172 to the emitters 154. The grid layer 170 and the holes 172 accordingly define the extraction grid 174 which is positioned over and aligned to the emitters 154. Also, the substrate 100, address line 142, emitters 154, insulator layer 160 and grid 174 together define an embodiment of a baseplate 180 in accordance with the invention.

Figure 3H:
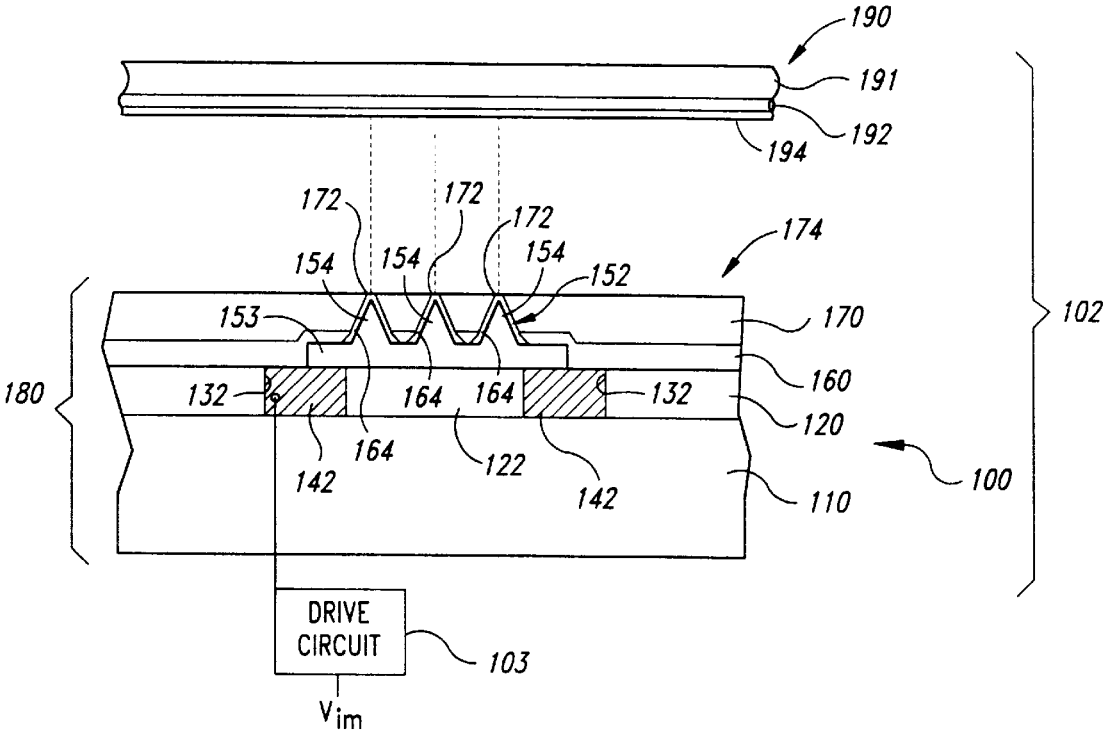
FIG. 3H is a partial schematic cross-sectional view illustrating a field emission display including the baseplate of FIG. 3G.

FIG. 3H illustrates an embodiment of a field emission display 102 with the baseplate 180 juxtaposed to a faceplate 190. The faceplate 190 has a display plate 191, a substantially transparent anode 192 covering an inner surface of the display plate 191, and a cathodoluminescent film covering the anode 192. The address line 142 is electrically coupled to a drive circuit 103 that receives an image voltage $V_{IM}$. Suitable drive circuitry 103 is known in the art of FEDs for use in computers, televisions and other applications. In operation, the extraction grid 174 is biased at a grid voltage $V_G$ of about 30–120 V and the anode 192 is biased at a high voltage $V_A$ of about 1-2 kV. When the voltage at the emitters 154 is much lower than the grid voltage $V_G$ (e.g., ground), the potential between the grid 174 and the emitters 154 produces a sufficiently intense electric field to extract electrons from the emitters 154. The high anode voltage $V_A$ pulls the extracted electrons across the gap between the faceplate 190 and the extraction grid 174 until they strike the cathodoluminescent film 194 causing light emission from the impact sites. The light passes through the transparent anode 192 and the display plate 191 where it is visible to an observer.

The embodiment of the method illustrated in FIGS. 3A–3H eliminates a metal etch step in the fabrication of FED baseplates by substituting a planarization process for the metal etch step. The address line 142 is thus formed without etching the conductive layer 140. As described above, etching metal layers is technically challenging because wet or dry etching of preferred conductive materials (e.g., aluminum or copper) is a dirty process that may befoul the substrate. Planarization processes are generally cleaner than metal etch processes, and they produce a planar surface that is less likely to entrap contaminants.

Also, the address line 142 is embedded in the substrate 100 to form a planar surface over which the emitters and the extraction grid may be constructed. Embedding the address lines in the substrate reduces step heights in the grid and grid-line structures, thereby making it easier to deposit conformal insulator layers and grid layers in the low-temperature fabrication of large, glassbased FED displays. The reduced step heights of the grid also makes it easier to planarize the grid layer to a desired endpoint because the substrate is more planar prior to planarization. Additionally, by positioning the address lines under the emitter sites, the emitter sites may be placed closer together compared to conventional address lines that surround the emitter sites on the top surface of the substrate. Therefore, an embodiment of the invention also reduces the complexity of manufacturing FEDs.

Figure 4A:
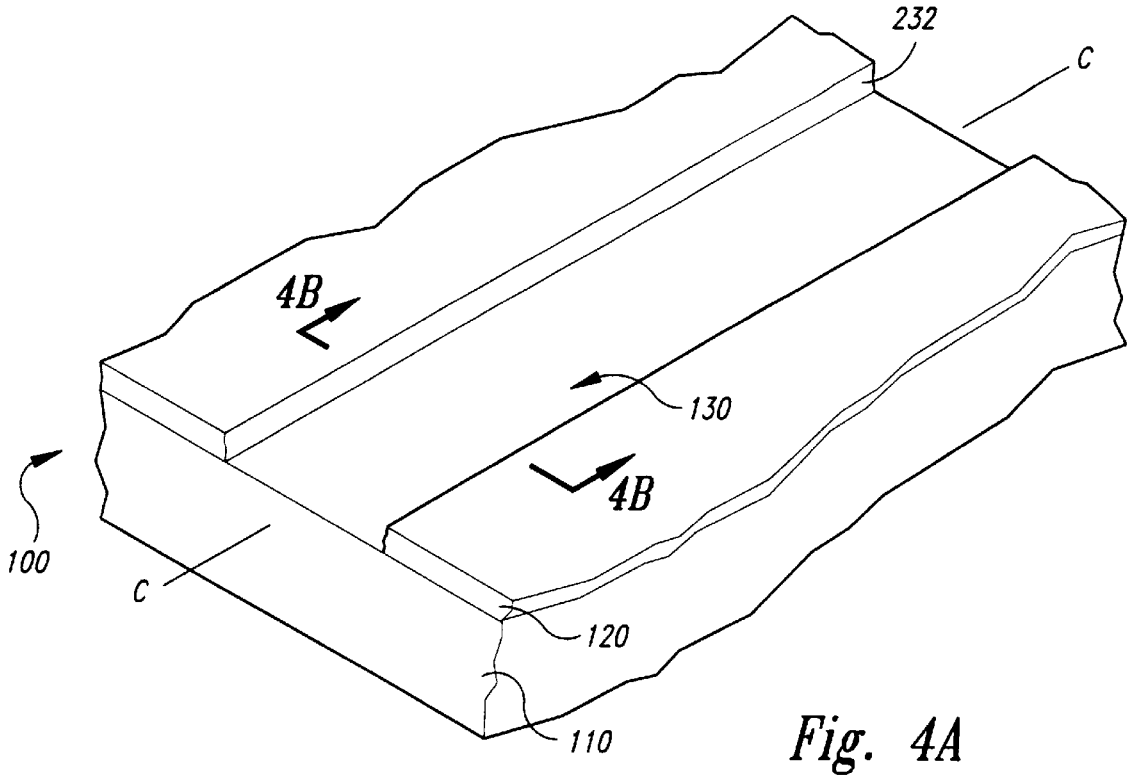
FIG. 4A is a partial schematic isometric view illustrating another substrate at a stage in another embodiment of a method for fabricating a baseplate of a field emission display in accordance with the invention.
Figure 4B:
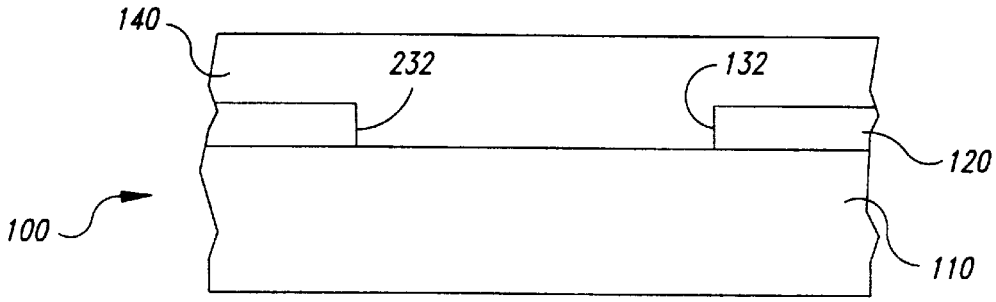
FIG. 4B is a partial schematic cross-sectional view illustrating the substrate of FIG. 4A at another stage of the method for fabricating a baseplate in accordance with the invention.
Figure 4C:
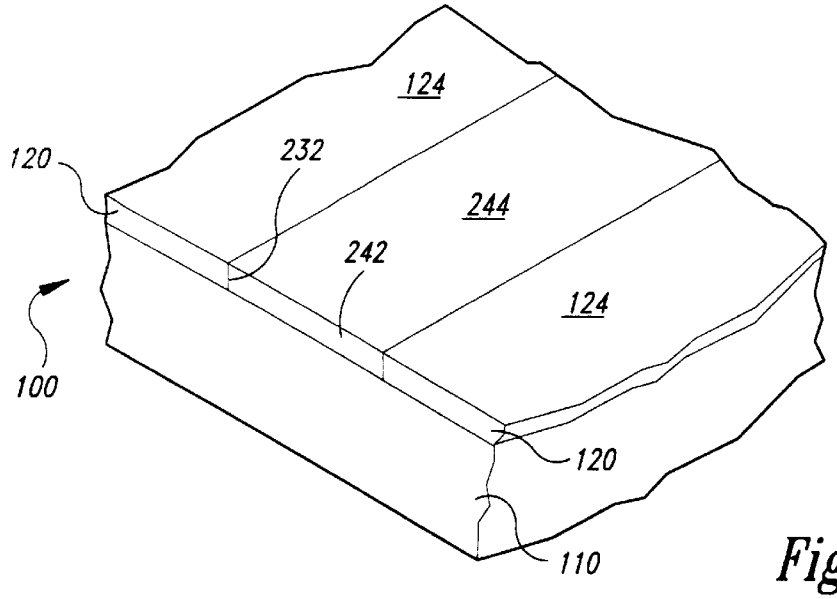
FIG. 4C is a partial schematic cross-sectional view illustrating the substrate of FIGS. 4A and 4B at another stage of the method for fabricating a baseplate in accordance with the invention.

FIGS. 4A–4C are partial schematic views that illustrate constructing another address line on the substrate 100 according to another embodiment of the invention. As shown in FIG. 4A, the substrate 100 has a base layer 110 and a dielectric layer 120 as discussed above with respect to FIG. 3A. However, unlike the embodiment shown in FIG. 3A, the void 130 is a trench 232 without the pads 122. The trench 232 is cut along a column line C—C of the substrate 100 by patterning and etching the trench with processes known in the art. After the trench 232 is cut in the dielectric layer 120, a conductive layer 140 deposited onto the substrate 100 covers the dielectric layer 120 and fills the trench 232 as shown in FIG. 4B. Referring to FIG. 4C, the conductive layer 140 is planarized to remove the excess portion of the conductive layer 140 and form a substantially unobstructed address line 242 in the trench 232. As discussed above with respect to FIG. 3C, an upper surface 244 of the address line 242 is at least substantially coplanar with the top surface 124 of the dielectric layer 120.

Figure 4D:
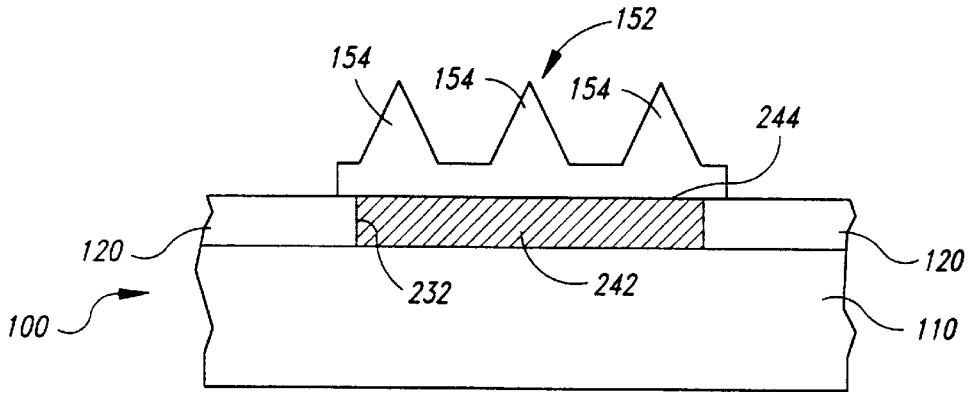
FIG. 4D is a partial schematic cross-sectional view illustrating the substrate of FIGS. 4A–4C at another stage of the method for fabricating a baseplate in accordance with the invention.
Figure 4E:
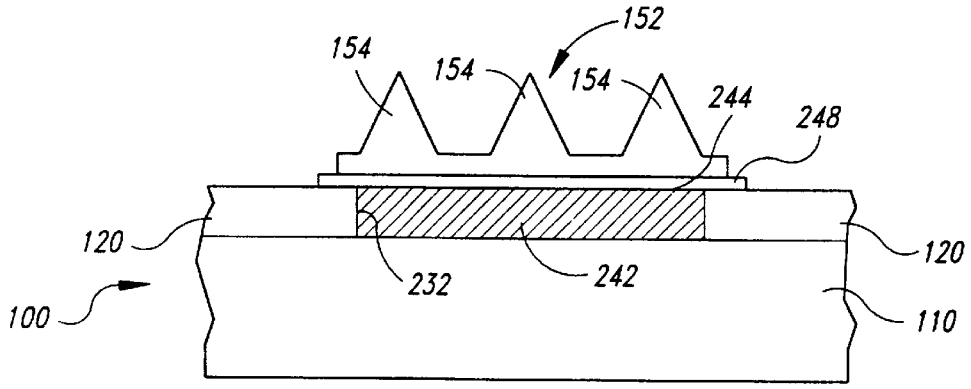
FIG. 4E is a partial schematic cross-sectional view illustrating another embodiment of a baseplate in accordance with the invention.

FIGS. 4D and 4E illustrate different embodiments of forming emitters over the address line 242. FIG. 4D illustrates one embodiment in which an emitter site 152 has emitters 154 formed superadjacent to the address line 242 so that the emitter material directly contacts the upper surface 244 of the address line 242 over the full width of the address line 242. FIG. 4E illustrates another embodiment in which an emitter site 152 contacts a passivation layer 248 covering the upper surface 244 of the address line 242. The passivation layer 248 is preferably a thin, conductive barrier encapsulating the address line 242 to protect the address line 242 from subsequent processing steps. The conductivity of the passivation layer 248 may be lower than that of the address line 242, but is preferably high enough to form a sufficiently conductive path between the address line 242 and the emitters 154 to operate the emitter site 152. The passivation layer 248, for example, may have a thickness less than about 1,000 Å, and it may be composed of titanium nitride, a copper-titanium alloy or other suitable materials. The passivation layer 248 is particularly useful in certain applications where the structure or materials of the address line 242 would be affected adversely by subsequent process steps.

Figure 5:
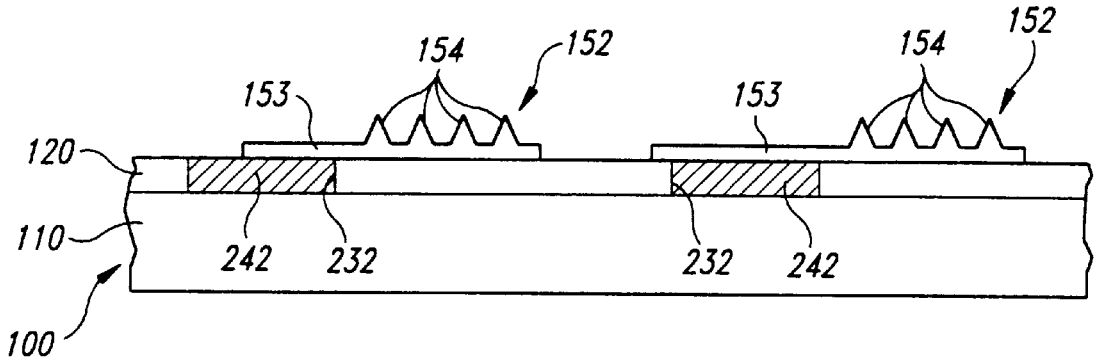
FIG. 5 is a schematic cross-sectional view illustrating still another embodiment of an address line and emitter structure on the substrate 100 in accordance with the invention.

FIG. 5 is a schematic cross-sectional view illustrating still another embodiment of an address line and emitter structure on the substrate 100 in accordance with another embodiment of the present invention. As shown in FIGS. 4A–4C, a plurality of address lines 242 are formed in a plurality of trenches 232 in the dielectric layer 120. Each emitter site 152 has a contact 153 superadjacent to at least a portion of a metal address line 242 and a plurality of emitters 154 superadjacent to a portion of the dielectric layer 120 adjacent to the address line 242. The contacts 153 and emitters 154 are preferably composed of polysilicon. Accordingly, as discussed above with respect to FIGS. 3D and 3E, the contacts 153 may be manipulated to act as current-limiting devices that limit the current to the emitters 154. Therefore, by embedding the metal address lines 142 and 242 in the dielectric layer 120, the emitters 154 may be constructed superadjacent to portions of the oxide layer 120 and/or portions of the address lines 142 and 242. Additionally, the embedded address lines 142 and 242 allow easy fabrication of current-limiting contacts for better control of the peak current to the emitters 154.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An emitter structure for a baseplate of a field emission display, comprising:

a substrate having a top surface;

an address line embedded in the substrate, the address line having an upper surface being at least substantially coplanar with the top surface of the substrate; and an emitter assembly having an emitter superjacent to the top surface of the substrate apart from the address line and a contact having a first portion coupled to the emitter and a second portion coupled to the address line.

2. The device of claim 1 wherein the substrate comprises a semiconductive base layer and the address line is embedded in the base layer.

3. The device of claim 1 wherein the substrate comprises a semiconductive base layer and a dielectric layer over the base layer, and wherein the address line is embedded at least in the dielectric layer.

4. The device of claim 3 wherein the address line is embedded in a trench across at least a portion of the dielectric layer.

5. The device of claim 4, further comprising a plurality of pads projecting upwardly from a bottom surface of the trench and being spaced apart along a longitudinal axis of the trench, and wherein an emitter site with at least one emitter is positioned over each pad and coupled to the address line in the trench.

6. The device of claim 4 wherein a plurality of emitter sites are positioned over the dielectric layer adjacent to a side of the address line, and each emitter site is electronically coupled to the address line.

7. The device of claim 4, further comprising a passivation layer over the address line.

8. The device of claim 7 wherein the passivation layer comprises titanium nitride.

9. The device of claim 7 wherein the passivation layer comprises a copper-titanium alloy.

10. The device of claim 1 wherein:

the substrate has a semiconductive base layer and a dielectric layer covering the base layer;

the dielectric layer has a trench extending across at least a portion of the substrate and a plurality of pads projecting upwardly from a bottom surface of the trench, the pads being spaced apart from one another along a longitudinal axis of the trench;

the address line is embedded in the trench;

a passivation layer is positioned over the address line; and an emitter set is positioned on each pad, each emitter set having at least one emitter coupled to the address line.

11. An emitter structure for a baseplate of a field emission display, comprising:

a substrate region having a top surface;

a metal address line embedded in the substrate region, the address line having an upper surface at least substantially coplanar with the top surface of the substrate; and an emitter assembly electrically coupled to the address line, the emitter assembly having an emitter superjacent to the top surface of the substrate apart from the address line and a contact having a first portion coupled to the emitter and a second portion coupled to the address line.

12. The device of claim 11 wherein the substrate comprises a semiconductive base layer and the address line is embedded in the base layer.

13. The device of claim 11 wherein the substrate comprises a semiconductive base layer and a dielectric layer over the base layer, and wherein the address line is embedded at least in the dielectric layer.

14. The device of claim 13 wherein the address line is embedded in a trench across at least a portion of the dielectric layer.

15. The device of claim 14, further comprising a plurality of pads projecting upwardly from a bottom surface of the trench and being spaced apart along a longitudinal axis of the trench, and wherein an emitter site with at least one emitter is positioned over each pad and coupled to the address line in the trench.

16. The device of claim 14, further comprising a passivation layer over the address line.

17. The device of claim 16 wherein the passivation layer comprises titanium nitride.

18. The device of claim 16 wherein the passivation layer comprises a copper-titanium alloy.

19. The device of claim 11 wherein:

the substrate has a semiconductive base layer and a dielectric layer covering the base layer;

the dielectric layer has a trench extending across at least a portion of the substrate and a plurality of pads projecting upwardly from a bottom surface of the trench, the pads being spaced apart from one another along a longitudinal axis of the trench;

the address line is embedded in the trench;

a passivation layer is positioned over the address line; and an emitter set is positioned on each pad, each emitter set having at least one emitter coupled to the address line.

20. An emitter structure for baseplate of a field emission display, comprising:

a substrate region having a top surface and a trench across at least a portion of the top surface, the trench having a depth at an intermediate level within the substrate;

a conductive line in the trench, the conductive line having an upper surface at least substantially coplanar with the top surface of the substrate; and an emitter assembly having an emitter superjacent to the top surface of the substrate apart from the address line and a contact having a first portion coupled to the emitter and a second portion coupled to the address line.

21. The device of claim 20 wherein the substrate comprises a semiconductive base layer and the conductive line is embedded in the base layer.

22. The device of claim 20 wherein the substrate comprises a semiconductive base layer and a dielectric layer over the base layer, and wherein the conductive line is embedded at least in the dielectric layer.

23. The device of claim 20, further comprising a plurality of pads projecting upwardly from a bottom surface of the trench and being spaced apart along a longitudinal axis of the trench, and wherein an emitter site with at least one emitter is positioned over each pad and coupled to the conductive line in the trench.

24. The device of claim 20, further comprising a passivation layer over the conductive line.

25. The device of claim 24 wherein the passivation layer comprises titanium nitride.

26. The device of claim 25 wherein the passivation layer comprises a copper-titanium alloy.

27. A conductive address structure in a field emission display, comprising:

a substrate having a top surface;

a conductive line embedded in the substrate along an address line, the conductive line having an upper surface at least substantially coplanar with the top surface of the substrate; and an emitter assembly having an emitter superjacent to the top surface of the substrate apart from the address line and a contact having a first portion coupled to the emitter and a second portion coupled to the address line.

28. The device of claim 27 wherein the substrate comprises a semiconductive base layer and the conductive line is embedded in the base layer.

29. The device of claim 27 wherein the substrate comprises a semiconductive base layer and a dielectric layer over the base layer, and wherein the conductive line is embedded at least in the dielectric layer.

30. The device of claim 29 wherein the conductive line is embedded in a trench across at least a portion of the dielectric layer.

31. The device of claim 30, further comprising a plurality of pads projecting upwardly from a bottom surface of the trench and being spaced apart along a longitudinal axis of the trench, and wherein an emitter site with at least one emitter is positioned over each pad and coupled to the conductive line.

32. The device of claim 30, further comprising a passivation layer over the conductive line.

33. The device of claim 32 wherein the passivation layer comprises titanium nitride.

34. The device of claim 32 wherein the passivation layer comprises a copper-titanium alloy.

35. The device of claim 27 wherein:

the substrate has a semiconductive base layer and a dielectric layer covering the base layer;

the dielectric layer has a trench extending across at least a portion of the substrate and a plurality of pads projecting upwardly from a bottom surface of the trench, the pads being spaced apart from one another along a longitudinal axis of the trench;

the conductive line is embedded in the trench and extends around portions of the pads;

a passivation layer is positioned over the conductive line; and an emitter set is positioned on each pad, each emitter set having at least one emitter coupled to the conductive line.

36. A field emission display, comprising:

a baseplate including a substrate having a top surface and an address line embedded in the substrate, the address line having an upper surface at least substantially coplanar with the top surface of the substrate, and the baseplate further including an emitter assembly coupled to the address line, the emitter assembly having an emitter superjacent to the top surface of the substrate apart from the address line and a contact having a first portion coupled to the emitter and a second portion coupled to the address line.

an extraction grid juxtaposed to the baseplate, the extraction grid having an aperture aligned with the emitter; and a faceplate juxtaposed to the extraction grid, the face plate having an inner surface facing the emitter, a conductive film over the inner surface, and a cathodoluminescent film over the conductive film.

37. The device of claim 36 wherein the baseplate substrate comprises a semiconductive base layer and the address line is embedded in the base layer.

38. The device of claim 36 wherein the baseplate substrate comprises a semiconductive base layer and a dielectric layer over the base layer, and wherein the address line is embedded at least in the dielectric layer.

39. The device of claim 38 wherein the address line is embedded in a trench across at least a portion of the dielectric layer.

40. The device of claim 39, further comprising a plurality of pads projecting upwardly from a bottom surface of the trench and being spaced apart along a longitudinal axis of the trench, and wherein an emitter site with at least one emitter is positioned over each pad and coupled to the address line.

41. The device of claim 39, further comprising a passivation layer over the address line.

42. The device of claim 41 wherein the passivation layer comprises titanium nitride.

43. the device of claim 41 wherin the passivation layer comprises a copper-titanium alloy.

44. The device of claim 36 wherein:

the substrate has a semiconductive base layer and a dielectric layer covering the base layer;

the dielectric layer has a trench extending across at least a portion of the substrate and a plurality of pads projecting upwardly from a bottom surface of the trench, the pads being spaced apart from one another along a longitudinal axis of the trench;

the address line is embedded in the trench and extends around portions of the pads;

a passivation layer is positioned over the address line; and an emitter set is positioned on each pad, each emitter set having at least one emitter coupled to the address line.

45. An emitter structure for a baseplate of a field emission display, comprising:

a substrate having a top surface;

an address line embedded in the substrate, the address line having an upper surface being at least substantially coplanar with the top surface of the substrate;

an emitter assembly coupled to the address line having an emitter superjacent to the top surface of the substrate apart from the address line and a contact having a first portion coupled to the emitter and a second portion coupled to the address line; and a drive circuit electrically coupled to the address line, the drive circuit receiving an image signal from an external source to control a voltage at the emitter via the address line.

* * * * *